US008365692B2

(12) United States Patent
Schoeneberg et al.

(10) Patent No.: US 8,365,692 B2
(45) Date of Patent: Feb. 5, 2013

(54) VALVE DRIVE FOR GAS EXCHANGE VALVES OF AN INTERNAL COMBUSTION ENGINE, COMPRISING A MOVABLE CAM SUPPORT AND TWIN WORM GEAR

(75) Inventors: Dirk Schoeneberg, Raitenbuch (DE); Joerg Wutzler, Zwickau (DE); Holger Voges, Tiefenbach (DE); Gero Bromme, Altenburg (DE)

(73) Assignee: Audi AG, Ingolstadt (DE)

( * ) Notice: Subject to any disclaimer, the term of this patent is extended or adjusted under 35 U.S.C. 154(b) by 109 days.

(21) Appl. No.: 12/529,663

(22) PCT Filed: Feb. 28, 2008

(86) PCT No.: PCT/EP2008/001576

§ 371 (c)(1),
(2), (4) Date: Jun. 15, 2010

(87) PCT Pub. No.: WO2008/107111

PCT Pub. Date: Sep. 12, 2008

(65) Prior Publication Data

US 2010/0269769 A1 Oct. 28, 2010

(30) Foreign Application Priority Data

Mar. 2, 2007 (DE) ..... 10 2007 010 149

(51) Int. Cl.
*F01L 1/34* (2006.01)

(52) U.S. Cl. ..... 123/90.18; 123/90.15; 123/90.6

(58) Field of Classification Search .... 123/90.15–90.18, 123/90.6

See application file for complete search history.

(56) References Cited

U.S. PATENT DOCUMENTS

| | | | | |
|---|---|---|---|---|
| 7,404,383 | B2 * | 7/2008 | Elendt | 123/90.16 |
| 7,409,938 | B2 * | 8/2008 | Dengler | 123/90.18 |
| 7,472,671 | B2 * | 1/2009 | Elendt et al. | 123/90.6 |
| 7,963,261 | B2 * | 6/2011 | Mock et al. | 123/90.39 |
| 2005/0011480 | A1 * | 1/2005 | Schultz et al. | 123/90.16 |
| 2010/0126445 | A1 * | 5/2010 | Schiepp et al. | 123/90.16 |
| 2010/0126447 | A1 * | 5/2010 | Talan et al. | 123/90.17 |
| 2010/0126448 | A1 * | 5/2010 | Talan et al. | 123/90.17 |
| 2010/0175652 | A1 * | 7/2010 | Schoeneberg et al. | 123/90.21 |
| 2010/0251982 | A1 * | 10/2010 | Elendt et al. | 123/90.18 |

FOREIGN PATENT DOCUMENTS

| | | | |
|---|---|---|---|
| DE | 196 11 641 | | 6/1997 |
| DE | 101 48 177 | A1 | 4/2003 |
| DE | 101 48 179 | A1 | 4/2003 |
| DE | 101 48 243 | A1 | 4/2003 |
| EP | 0 579 592 | A | 1/1994 |
| EP | 1 503 048 | A | 2/2005 |
| EP | 1 608 849 | A | 12/2005 |
| EP | 1 609 961 | A | 12/2005 |

* cited by examiner

*Primary Examiner* — Thomas Denion
*Assistant Examiner* — Daniel Bernstein
(74) *Attorney, Agent, or Firm* — Novak Druce + Quigg LLP

(57) ABSTRACT

A valve drive assembly cooperable with gas exchange valves of an internal combustion engine having a cam shaft and at least one came support rotatably fixed and axially displaceable on the cam shaft and having at least two cam profiles selectively engageable with a roller provided on a follower engageable with a valve comprising a cam support having a cylindrical surface disposed coaxially with a cam shaft, provided with a pair of oppositely inclined, spiral grooves; and means selectively insertable into the grooves, coacting with side walls of such grooves as the cam shaft rotates to effect axial displacement of the cam support.

11 Claims, 4 Drawing Sheets

VALVE DRIVE FOR GAS EXCHANGE VALVES OF AN INTERNAL COMBUSTION ENGINE, COMPRISING A MOVABLE CAM SUPPORT AND TWIN WORM GEAR

The invention relates to a valve drive for gas exchange valves of an internal combustion engine.

BACKGROUND OF THE INVENTION

To improve the thermodynamic properties of internal combustion engines, valve drives, in which the working cycle can be influenced in order to make it possible to vary, for example, as a function of speed, the opening times or the stroke of the gas exchange valves, are known.

A valve drive of the initially mentioned type is already known from EP 1 608 849 B1. In the known valve drive, for axial movement of the cam support, the devices comprise two worm drives with mirror-image curved pathways, which are arranged on the opposing front ends of the cam support and comprise a right-twist or a left-twist helical groove, as well as with two final control elements that are mounted at the axial distance in the cylinder head housing of the internal combustion engine, elements which in each case comprise an engaging element that is designed as a carrier pin, which can be engaged with the groove of the adjacent curved pathway by activating the final control element, in order to move the cam support to the right or the left.

To improve the possibilities for influencing the working cycle of the valve drive, it would be desirable to expand the cam groups or cam profile groups of the cam support by another cam or another cam profile with another contour. This necessitates, however, moving the cam support back and forth between three different shift positions. A scaling-up of the number of final control elements or actuators in the cylinder head or a widening of a section of the cam support that is provided with the curved pathways is undesirable, however, not only because of the larger axial installation space required for this purpose but also because of the higher assembly cost.

Based on this, the object of the invention is to improve a valve drive of the initially mentioned type to the extent that the axial installation space required for the final control element or the curved pathways and the number of parts to be mounted can be reduced.

SUMMARY OF THE INVENTION

This object is achieved according to the invention in that the right-hand groove and the left-hand groove are arranged directly adjacent to one another and undergo transition into each other or merge.

The terms right-hand and left-hand groove in the scope of this invention relate to the direction of rotation of the groove between its entrance, on which an engaging element is engaged with the groove, and its exit, on which the engaging element is disengaged again from the groove. The slope of the groove generally extends over an angle of rotation of the camshaft of approximately 180 degrees, corresponding to a base circle section of the cams and/or cam profiles on the cam support, while the grooves as a whole also extend over a larger angle of rotation and, in addition, to one section with a slope, can comprise one or more sections extending in the peripheral direction of the cam support.

By the combination of features according to the invention, the portion of the two grooves that is behind the merging in both shift directions of the cam support can be used for the engagement of an engaging element, as a result of which the total width and thus the necessary axial installation space of the curved pathways can be reduced. In addition, the individual final control elements can be combined into a single final control element with several engaging elements according to a preferred configuration of the invention, the space requirement of said engaging elements also being smaller than the space requirement of the individual final control elements.

DETAILED DESCRIPTION OF THE PREFERRED EMBODIMENTS OF THE INVENTION

Figure 1:
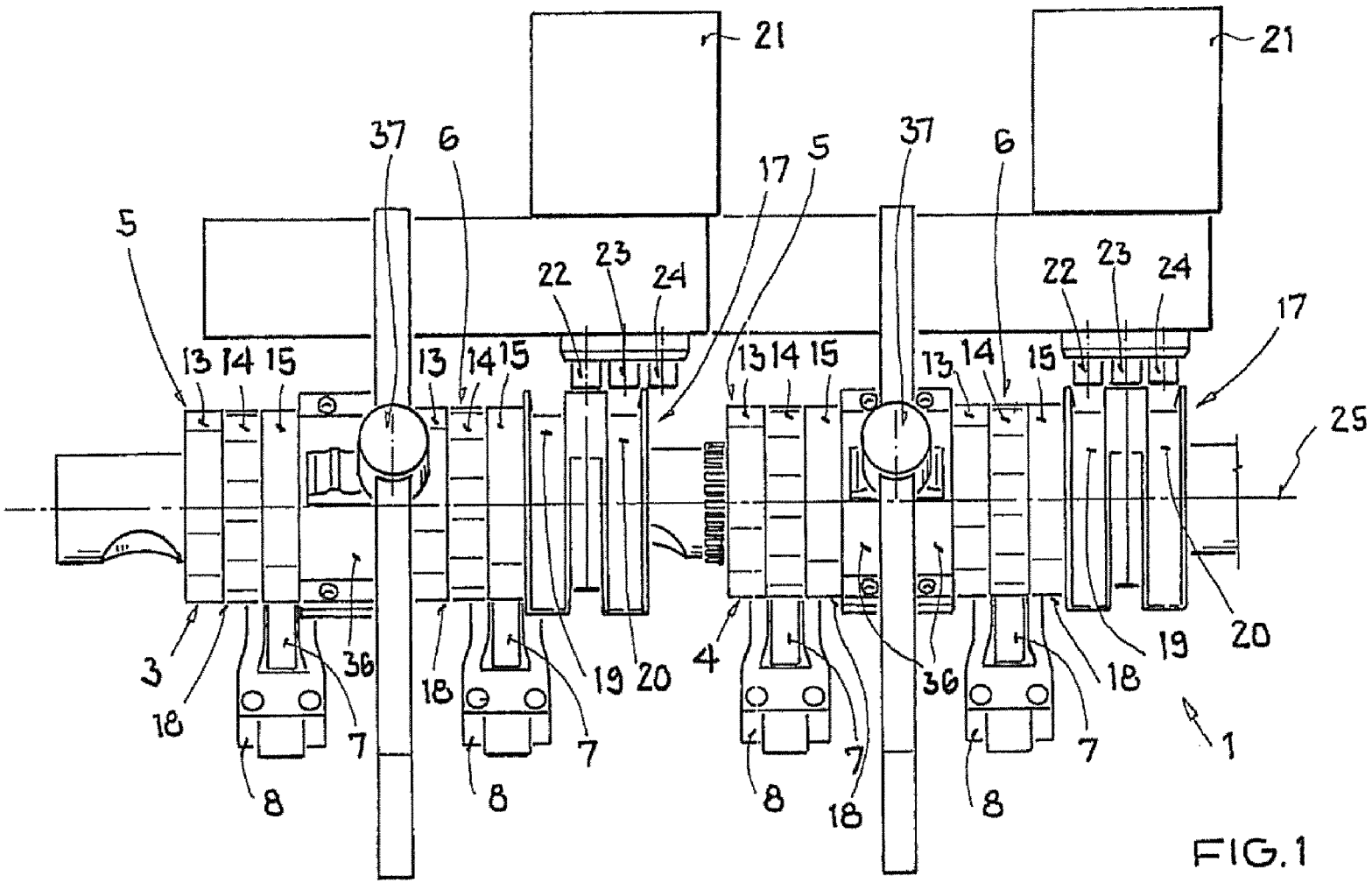
FIG. 1: shows a top view from above on parts of a valve drive for a plurality of intake valves of cylinders of an internal combustion engine, which comprises two cam supports that can move on a camshaft.

With the valve drive 1, only partially shown in the drawing, for four intake valves (not shown) of cylinders of an internal combustion engine with an overhead camshaft 2 that is mounted to rotate in a cylinder head housing of the internal combustion engine, the stroke and the opening times of the two intake valves of each cylinder that are actuated by the camshaft 2 can be adjusted.

Figure 2:
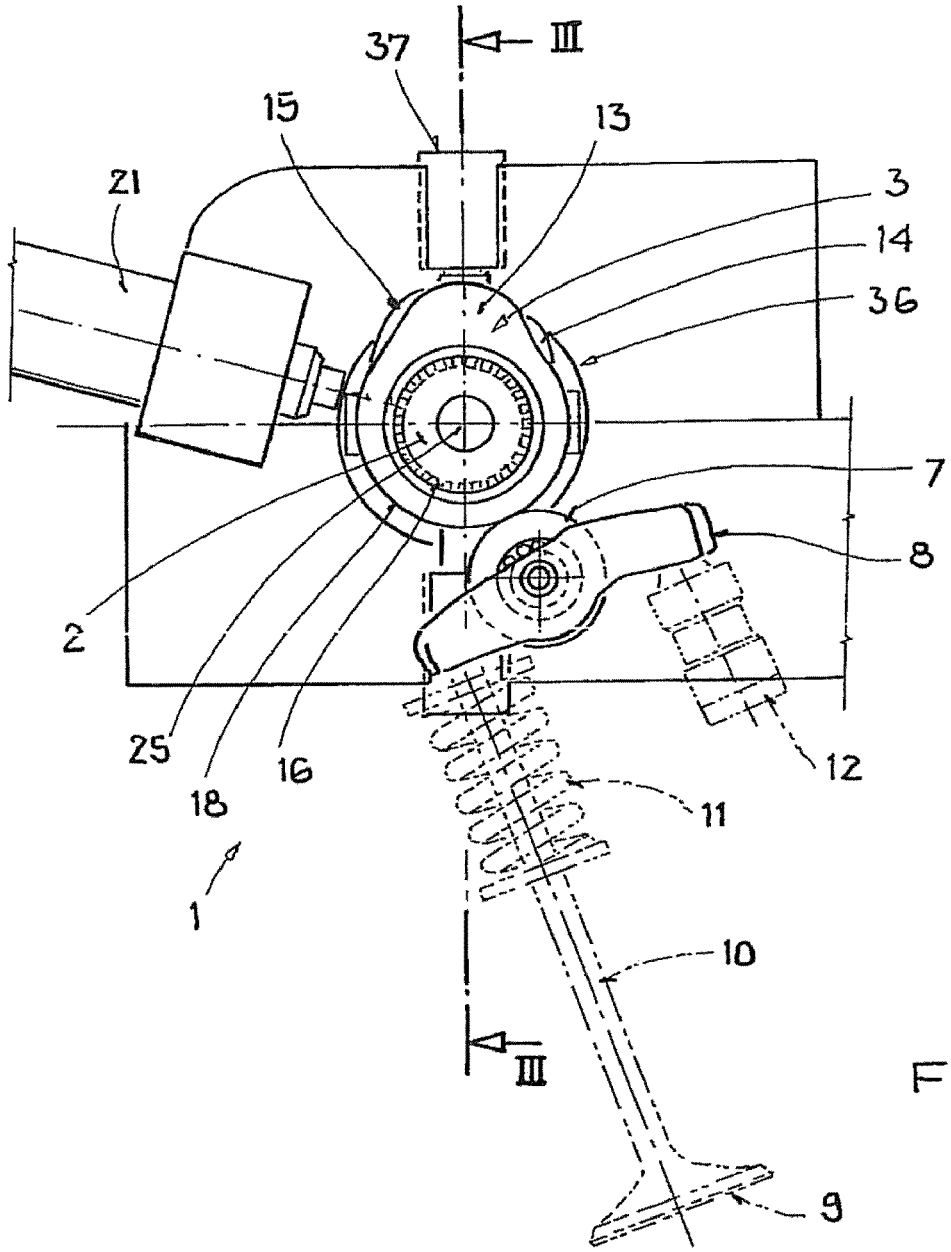
FIG. 2: shows a front side view of the valve drive in the direction of arrows II-II in FIG. 1.
Figure 3:
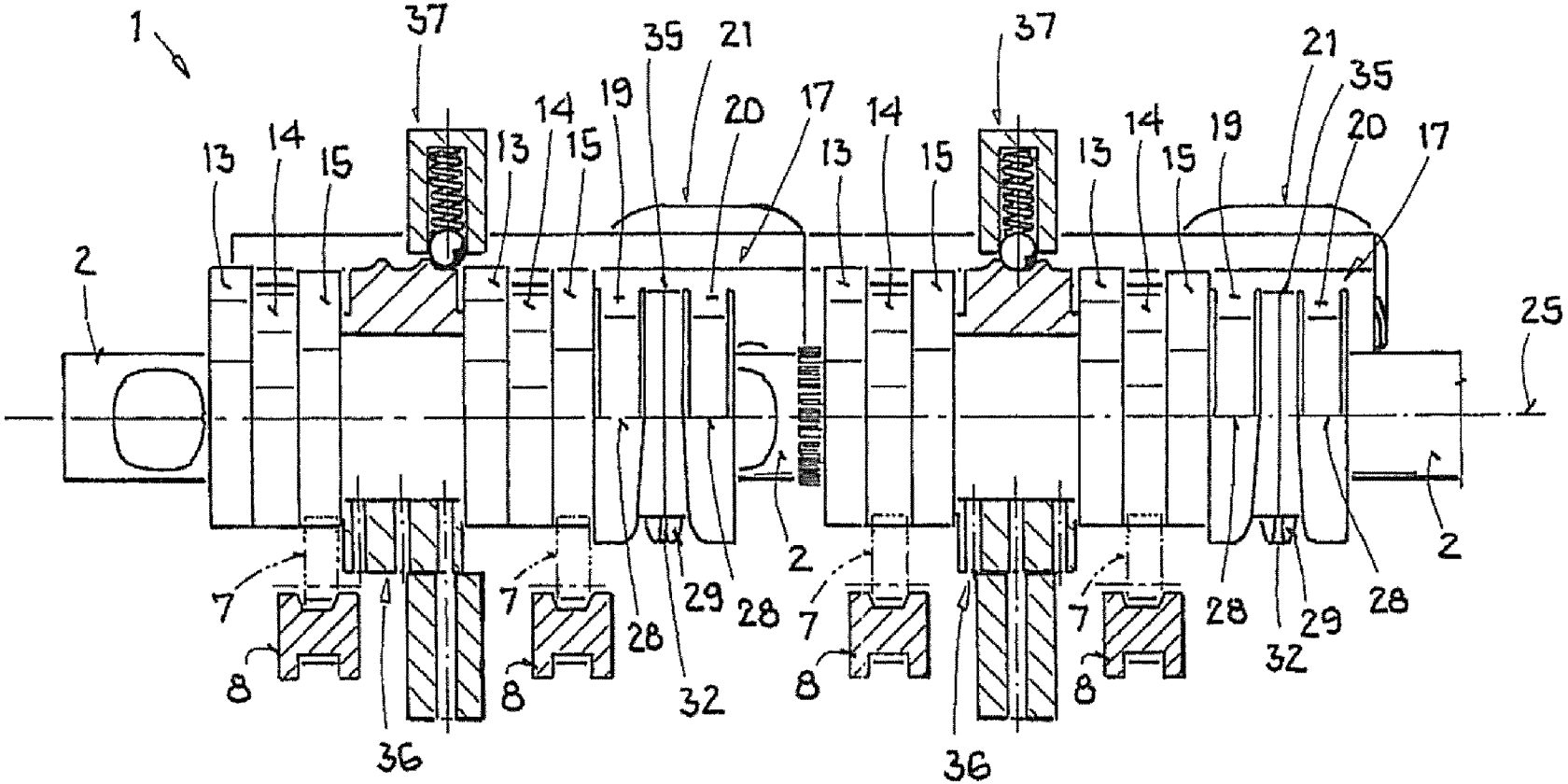
FIG. 3: shows a longitudinal section view of the valve drive along the line III-III of FIG. 2.

As best shown in FIGS. 1 and 3, the valve drive 1 in this respect for each pair of intake valves comprises a rotationally fixed and axially movable cam support 3 or 4 that is mounted on the camshaft 2, whereby each cam support 3, 4 has two cam groups 5, 6 that are arranged at an axial distance from one another. Each of the two cam groups 5, 6 works together with a roller 7 of a pivoting roller cam follower 8 of one of the valves. Via the roller 7, a valve link 10 that is provided on the lower end with a valve disk 9, shown in FIG. 2 in dashed lines, is actuated, and said valve link can be pressed downward against the force of a valve spring 11 in the cylinder head to open the respective valve. For each of the valves, moreover, the valve drive 1 comprises a hydraulic valve play equalization element 12 that is also shown in FIG. 2 in dashed lines.

Each of the two cam groups 5, 6 of each cam support 3, 4 has three cams 13, 14, and 15, which have different cam contours or cam profiles and can be brought into mechanical contact selectively with the roller 7 of the cam follower 8 of the related valve by axial movement of the related cam support 3, 4 on the camshaft 2. The measurement of the axial movement of the cam support 3, 4 between two adjacent shift positions corresponds to the center distance of adjacent cams 13, 14 or 14, 15 or cam profiles.

To connect the cam supports 3, 4 in a rotationally fixed and axially movable manner to the camshaft 2, the hollow-cylindrical cam supports 3, 4 on their inner peripheries have a longitudinal gearing that combs with a complementary outside gearing against the camshaft 2, as shown in FIG. 2 at 16.

The axial movement of the two cam supports 3, 4 on the camshaft 2 is carried out in each case using a worm drive 17 and is always performed when an integral base circle section 18 of the cam groups 5, 6 faces the rollers 7 of the cam follower 8 during an angle of rotation of the camshaft 2 of approximately 180 degrees.

Each of the worm drives 17 comprises a right-hand groove 19 and a left-hand groove 20, which are arranged adjacent to one another on the right front end of the related cam support 3 or 4 and undergo transition into each other or merge, as well as a final control element 21, which is mounted in a stationary manner in the cylinder head housing, with three engaging elements 22, 23, 24 that can extend separately from one another by corresponding activation of the final control element 21 from a run-in position shown in FIGS. 1 and 5, and can be engaged with one of the two grooves 19, 20 in order to move the cam supports 3, 4 in each case in steps to the right or to the left by the center distance between two adjacent cams 13, 14 or 14, 15, as will be explained in more detail below.

Figure 4:
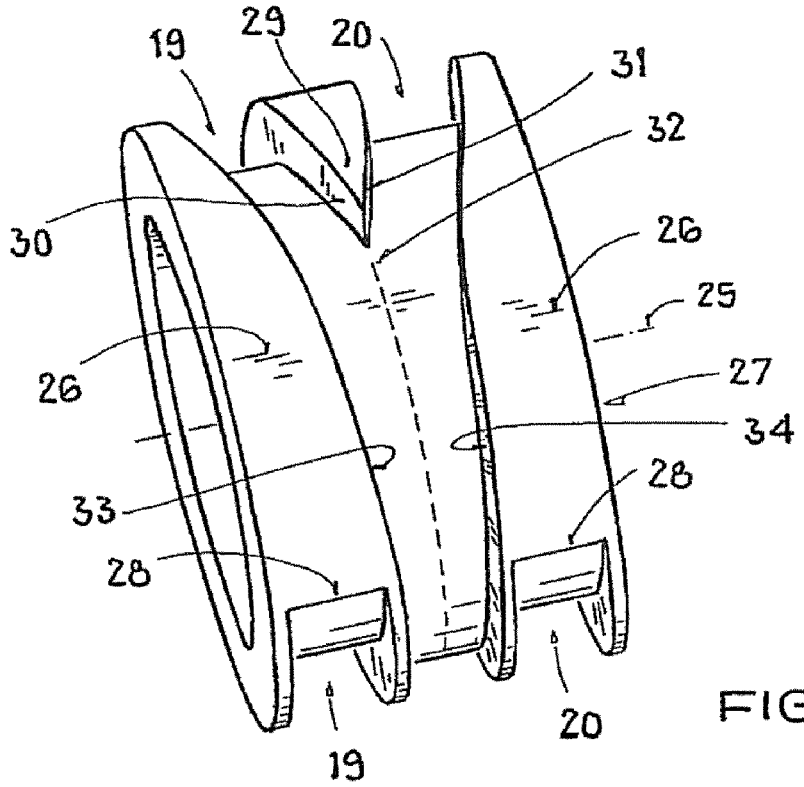
FIG. 4: shows a perspective view of a section of one of the cam supports with a portion of a worm drive.

As best shown in FIG. 4, the two grooves 19, 20 in the cylindrical peripheral surface 26 of a section 27 of the cam support 3, 4 that is coaxial with the axis of rotation 25 of the camshaft 2 are recessed on one of its front ends, whereby they are symmetrical to a radial center plane of the section 27. Each of the two grooves 19, 20 has an entrance 28, from which the grooves 19, 20 gradually become deeper and first are extended with a uniform groove width. The entrances 28 of the two grooves 19, 20 are in each case close to the opposing front ends of the section 27 and are in each case oriented by the same angle of rotation to the axis of rotation 25, their orientation coinciding with the end of the base circle section 18 of the cam groups or cam profile groups 5, 6. From the entrance 28, the two grooves 19, 20 extend separately from one another approximately over an inscribed angle of approximately 270 degrees, whereby they first run over an inscribed angle of approximately 180 degrees in the peripheral direction, while one of the cams 13, 14, 15 moves over the roller 7 of the related cam follower 8. While the base circle section 18 of the cam groups or cam profile groups 5, 6 moves over the roller 7, the grooves 19, 20 then run toward one another in the opposite direction of rotation, the distance of their two center axes gradually decreasing and a partition 29 arranged between the grooves 19, 20 becoming gradually more narrow until the inner boundary walls 30, 31 of the grooves 19, 20 that are adjacent to one another converge at the point 32 at which the grooves 19, 20 merge. Behind the merging point 32, the center axis of the merged grooves 19, 20 extends in the peripheral direction of the section 27, while the opposing outer boundary walls 33, 34 of the merged grooves 19, 20 converge in the direction of rotation of the cam support 3, 4 up to the end of the base circle section 18, so that the width of the merged grooves 18, 19 at the height of the entrances 28 again corresponds to the width of one of the individual grooves 19 or 20. From there, the merged grooves 19, 20 run in the peripheral direction up to the exit 35 (FIGS. 3 and 5), which is spaced apart angularly by approximately 180 degrees behind the merging point 32 and is offset relative to the entrances 28 of the two grooves 19, 20 by approximately 90 degrees in the direction of rotation of the camshaft 2.

As best shown in FIG. 1, adjacent engaging elements 22, 23; 23, 24 are arranged in the axial direction of the camshaft 2 in each case at a distance that corresponds to the center distance of adjacent cams 13, 14, 15 and/or cam profiles, said distance also corresponding to the center distance between the entrance 28 of one of the two grooves 19, 20 and their common exit 35.

The mode of operation of the worm drive is as follows: if the cam support 3, 4 is to be moved to the right into the center shift position from the outer left shift position, shown in FIG. 5*a*, the final control element 21 is activated in order to extend the center engaging element 23, which is shown in black in FIG. 5*a*, and to engage it with the left-hand groove 20. The extension of the engaging element 23 is carried out before the entrance 28 of the groove 20 in the direction of rotation of the camshaft 2 (arrow D in FIG. 5) moves in front of the intake element 23, so that its free end enters the entrance 28 in the groove 20 and moves during a rotation of the camshaft 2 from approximately 450 degrees through the entire left-hand groove 20 to the common exit 35 of the two grooves 19, 20.

If the cam support 3, 4 is to remain in the center shift position, the center engaging element 23 is then retracted, and no other engaging element 22, 23, 24 is extended any more. If, however, the cam support 3, 4 is to be moved via the center shift position toward the right into the outer right shift position that is shown in FIG. 5*c*, the right outer engaging element 24, shown in black in FIG. 5*b*, is extended and engaged in the entrance 28 with the left-hand groove 20, by which it then moves through to the common exit 35.

Figures 5A, 5B, 5C:
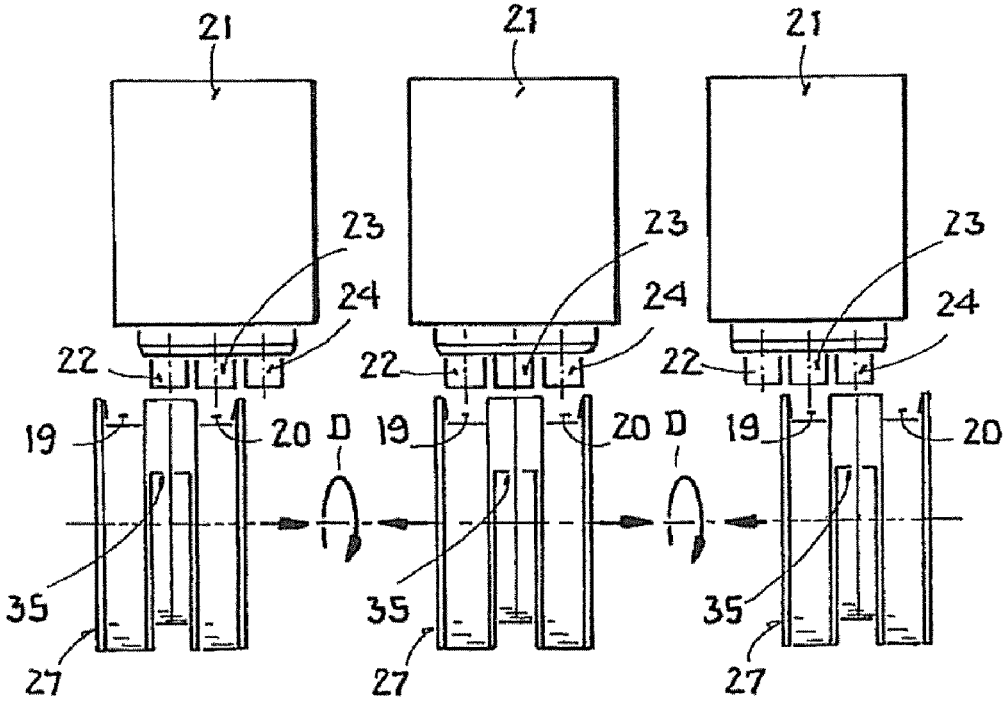
FIGS. 5*a* to *c*: show schematic side views of the worm drive to explain its mode of operation.

If the cam support 3, 4 from the right outer shift position is to be moved back to the left into the center shift position shown in FIG. 5*b*, the center engaging element 23, shown in black in FIG. 5*c*, is extended in a corresponding way and engaged on the entrance 28 with the right-hand groove 19, while the left outer engaging element 22, which is shown in black in FIG. 5*b*, is extended and engaged with the right-hand groove 19 in order to move the cam support 3, 4 from the center shift position to the left into the left outer shift position shown in FIG. 5*a*.

To center the cam supports 3, 4 relative to the axis of rotation of the camshaft 2 or to keep it centered during its movement relative to the axis of rotation, the cam supports 3 and 4 in each case are mounted to rotate between two valves in plain bearings 36, which can move axially together with the cam supports 3, 4.

The design and the mode of operation of the movable plain bearing 36 are described in detail in a co-dependent patent application of the applicant corresponding to PCT Application No. PCT/EP2008/001564 which is incorporated herein by reference.

To hold the cam support 3, 4 in the respective shift position, the plain bearings 36 can be stopped axially in any shift position by means of a stopping device 37.

The design and the mode of operation of the stopping device 37 are described in detail in the aforementioned PCT Application.

The invention claimed is:

1. A valve drive for gas exchange valves of an internal combustion engine with at least one camshaft, which is mounted to rotate in a housing of the internal combustion engine, at least one cam support that is guided in a rotationally fixed and axially movable manner on the camshaft, as well as devices for axial movement of at least one cam support on the camshaft in opposite directions, comprising at least two engaging elements, which can be engaged with a right-hand or left-hand groove, wherein the right-hand groove and the left-hand groove are arranged directly adjacent to one another and undergo transition into each other or merge, wherein the cam support comprises at least one cam profile group with three different cam profiles and can be moved into three discrete shift positions, whose distance corresponds to the center distance of the cam profiles, and wherein the engaging elements are arranged in the axial direction of the camshaft at a distance that corresponds to the center distance of the cam profiles.

2. The valve drive according to claim 1, wherein the right-hand groove and the left-hand groove merge in a V-shape to form a groove with a center axis that runs in the peripheral direction.

3. The valve drive according to claim 1 wherein the grooves have a common exit.

4. The valve drive according to claim 1, wherein the center distance between entrances of the left-hand or right-hand groove and an exit of the merged grooves corresponds to the center distance of the earn profiles.

5. The valve drive according to claim 1 wherein the right-hand and the left-hand groove are designed on the cam support, and wherein the engaging elements are engaged with one of the grooves by at least one final control element that is mounted in a stationary manner in the housing of the internal combustion engine.

6. The valve drive according to claim. 1 wherein said cam support is axially displaceable from a lateral position to a center position by insertion of a centrally disposed engaging element into an aligned groove of said cam support, and is axially displaceable from a center position to a lateral position by insertion of an engaging element displaced axially relative to said centrally disposed engaging element, into an aligned groove of said cam support.

7. A valve drive assembly cooperable with a valve of an internal combustion engine having a camshaft, comprising:

at least one support member rotatably fixed and axially displaceable on said camshaft, provided with at least two can profiles each engageable with a roller on a follower engageable with a valve, and axially spaced, oppositely inclined, spiral groves; and three elements spaced axially and disposed radially relative to said camshaft, each selectively displaceable into and out of an aligned one of said grooves, wherein said support member is axially displaceable from a lateral position to a center position by insertion of a centrally disposed one of said displaceable elements into an aligned groove of said support member, and is axially displaceable from a center position to a lateral position by insertion of one of said engaging elements displaced axially relative to said centrally disposed one of said displaceable elements, into an aligned groove of said support member.

8. A valve drive assembly according to claim 7 wherein said grooves are provided with a first set of merging ends and a second set of spaced ends.

9. A valve drive assembly according to claim 7 wherein ends of said grooves are circumferentially spaced.

10. A valve drive assembly according to claim 7 wherein said grooves are provided with base surfaces which merge with a portion of said cylindrical surface of said cam support.

11. A valve drive assembly according to claim 7 wherein said cam profiles include angularly displaced lobes relative to the axis of said camshaft.

* * * * *

UNITED STATES PATENT AND TRADEMARK OFFICE

CERTIFICATE OF CORRECTION

PATENT NO. : 8,365,692 B2
APPLICATION NO. : 12/529663
DATED : February 5, 2013
INVENTOR(S) : Schoeneberg et al.

It is certified that error appears in the above-identified patent and that said Letters Patent is hereby corrected as shown below:

In the Claims:

Claim 4: Column 5, Line 10: "...center distance of the ~~earn~~ cam profiles."
Please replace the word "earn" with the word "cam".

Claim 6: Column 5, Line 17: "The valves according to claim[.] 1 wherein..."
Please delete the "." after the word "claim".

Claim 7: Column 6, Line 1: "...~~can~~ cam profiles each engageable..."
Please replace the word "can" with the word "cam".

Signed and Sealed this
Thirtieth Day of April, 2013

Teresa Stanek Rea
*Acting Director of the United States Patent and Trademark Office*